United States Patent [19]

Tsubata

[11] 4,354,532

[45] Oct. 19, 1982

[54] WOVEN SLIDE FASTENER STRINGER

[75] Inventor: Noritaka Tsubata, Uozu, Japan

[73] Assignee: Yoshida Kogyo K. K., Tokyo, Japan

[21] Appl. No.: 173,758

[22] Filed: Jul. 30, 1980

[30] Foreign Application Priority Data

Jul. 31, 1979 [JP] Japan ..... 54-105805[U]

[51] Int. Cl.[3] ..... A44B 19/42; D03D 1/00

[52] U.S. Cl. ..... 139/384 B; 139/416; 24/205.16 C

[58] Field of Search ..... 139/384 B, 384 R, 383 R, 139/416–418, 408, 413; 24/205.16 C, 205.13 C

[56] References Cited

U.S. PATENT DOCUMENTS

| | | | |
|---|---|---|---|
| 365,147 | 6/1887 | Moschowitz | 139/383 R |
| 1,622,250 | 3/1927 | Moore | 139/384 B |
| 1,813,266 | 7/1931 | Woods | 139/413 X |
| 2,564,454 | 8/1951 | Stohlman | 139/383 R |
| 3,892,262 | 7/1975 | Dahlmann | 139/384 B |
| 3,951,181 | 4/1976 | Tsubata | 139/384 B |

FOREIGN PATENT DOCUMENTS

| | | | |
|---|---|---|---|
| 1542750 | 9/1968 | France | 139/384 B |
| 1092228 | 11/1967 | United Kingdom | 139/383 R |

*Primary Examiner*—James Kee Chi

*Attorney, Agent, or Firm*—Hill, Van Santen, Steadman, Chiara & Simpson

[57] ABSTRACT

A woven slide fastener stringer comprising a stringer tape woven of warp and weft yarns and a row of fastener coupling elements in the form of a coiled or zig-zag-shaped filament woven into the stringer tape along a longitudinal edge thereof. The stringer tape includes a first marginal portion adjacent to the fastener-element-supporting tape edge, a second marginal portion adjacent to the other longitudinal tape edge, and an intermediate portion extending between the first and second marginal portions, the intermediate portion having a woven structure coarser and thicker than that of the first marginal portion. The number of interlacings of the warp and weft yarns per unit area in the intermediate tape portion is smaller than that in the first marginal tape portion.

2 Claims, 8 Drawing Figures

WOVEN SLIDE FASTENER STRINGER

BACKGROUND OF THE INVENTION

1. Field of the Invention

The present invention relates generally to a slide fastener, and more particularly to a woven slide fastener stringer including a woven stringer tape and a row of fastener coupling elements woven into the stringer tape along a longitudinal edge thereof.

2. Prior Art

Woven slide fastener stringers are known in which a row of fastener coupling elements in the form of a coiled or zigzag-shaped filament is woven into a woven stringer tape along a longitudinal edge thereof simultaneously with the weaving of the tape. In order to provide a firm attachment of the coupling elements to the tape, a high degree of tension is applied on the successive weft yarns while the latter are being woven into the tape. Consequently, the prior stringer tape has a closely woven structure which does not allow a sewing needle to penetrate smoothly therethrough. Closeness of this woven structure increases progressively from a tape portion adjacent to the coupling-element-supporting tape edge to that adjacent to a selvedge of the tape at which side the weft yarns are tightened. With such prior slide fastener, easy and proper sewing operation is difficult to achieve. Moreover, the prior fastener stringer, when attached to a garment, tends to become wavy or puckered.

French Pat. No. 1,542,750 discloses a woven stringer tape having a coarsely woven portion so that a sewing needle can penetrate smoothly therethrough. However, the coarsely woven portion is disposed adjacent to the tape edge along which a row of fastener coupling elements is attached. With this arrangement, a firm and proper attachment of the coupling elements to the tape is difficult to achieve.

SUMMARY OF THE INVENTION

A primary object of the present invention is to provide a woven slide fastener stringer which can be sewn to a garment easily and properly.

Another object of the invention is to provide a woven slide fastener stringer which is free from becoming wavy or puckered when attached to a garment.

Still another object of the invention is to provide a woven slide fastener stringer in which a row of fastener coupling elements is attached to a stringer tape with sufficient firmness though the stringer tape includes a coarsely woven portion.

According to the present invention there is provided a woven slide fastener stringer comprising a stringer tape woven of warp and weft yarns and including a first marginal portion disposed adjacent to one longitudinal tape edge, a second marginal portion disposed adjacent to the other longitudinal tape edge, and an intermediate portion extending between the first and second marginal portions, the intermediate portion having a woven structure coarser and thicker than that of the first marginal portion, the number of interlacings of the warp and weft yarns per unit area in the intermediate portion being smaller than that in the first marginal portion.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION OF THE PREFERRED EMBODIMENTS

Figure 1:
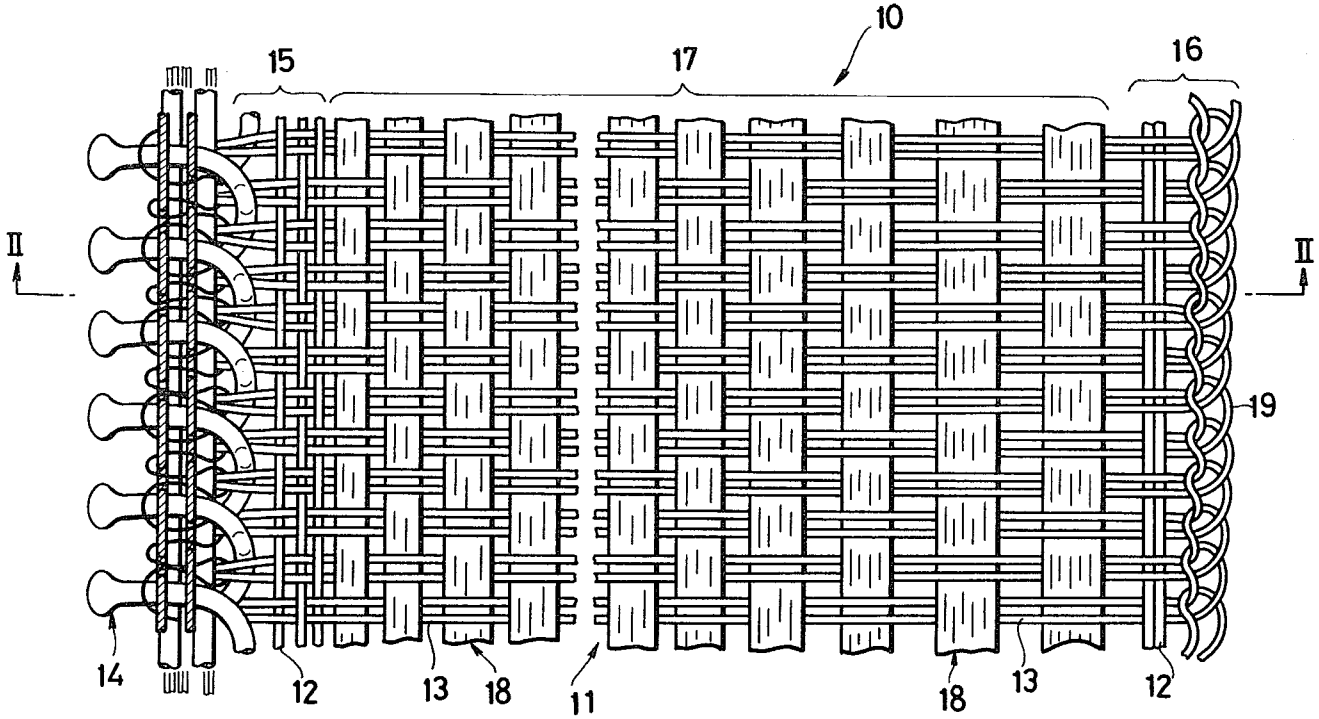
FIG. 1 is a fragmentary schematic plan view of a woven slide fastener stringer embodying the present invention.
Figure 2:
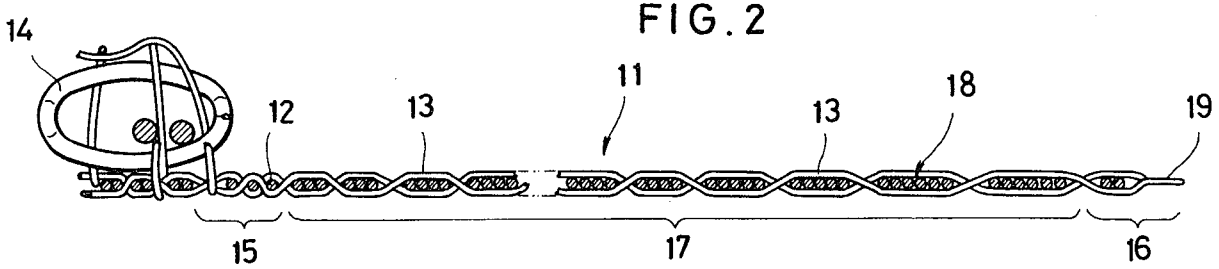
FIG. 2 is a cross-sectional view taken along line II—II of FIG. 1.

The principles of the present invention are particularly useful when embodied in a woven slide fastener stringer such as shown in FIGS. 1 and 2, generally indicated by the numeral 10.

The slide fastener stringer 10 comprises a stringer tape 11 woven of warp and weft yarns 12,13 in "plain weave" and a row of fastener coupling elements 14 woven into the tape 11 along one longitudinal edge thereof in a known manner. A high degree of tension is applied on the successive weft yarns 13 while the latter are being woven into the tape 11.

The plain-weave tape 11 includes a first marginal portion 15 adjacent to the said one longitudinal edge, a second marginal portion 16 adjacent to other longitudinal edge, i.e. a selvedge, and an intermediate portion 17 extending between the first and second marginal portions 15,16. The weft yarns 13 extend over one of the warp yarns 12 and under the next alternately across the first marginal portion 15 so that the latter has a sufficiently closely woven structure to keep the coupling elements 14 firmly on the tape 11.

Across the intermediate tape portion 17 the weft yarns 13 extend over a group 18 of the warp yarns 12 and under the next group alternately. The warp yarns 12 in each group 18 are arranged in a row (FIG. 2), and are kept close to one another due to the highly tensioned weft yarns 13. Thus, the intermediate portion 17 has a woven structure coarser and thicker than that of the first marginal portion 15, and the number of interlacings of the warp and weft yarns 12,13 in the intermediate portion 17 is smaller per unit area than that in the first marginal portion 15. With such a coarsely woven structure the intermediate tape portion 17 allows a sewing needle (not shown) to penetrate smoothly therethrough so that the slide fastener stringer 10 can be attached onto a garment (not shown) easily and properly. Moreover, because of its sufficient thickness at the intermediate portion 17, the stringer tape 11 is prevented from becoming wavy or puckered when attached to a garment.

Given that the weft yarns 13 are tightened on the selvedge side, the number of the warp yarns 12 in the groups 18 increases gradually from the group adjacent to the first marginal portion 15 to that adjacent to the second marginal portion 16. This makes the woven structure of the intermediate portion 17 coarser and thicker gradually from the coupling-element side to the selvedge side.

At the second marginal tape portion 16 a pair of the warp yarns 12 is interlaced with the weft yarns 13 along a succession of loops 19 of the weft yarns 13 immediately inwardly thereof to prevent the weft yarns 12 from being excessively tightened.

Figure 3:
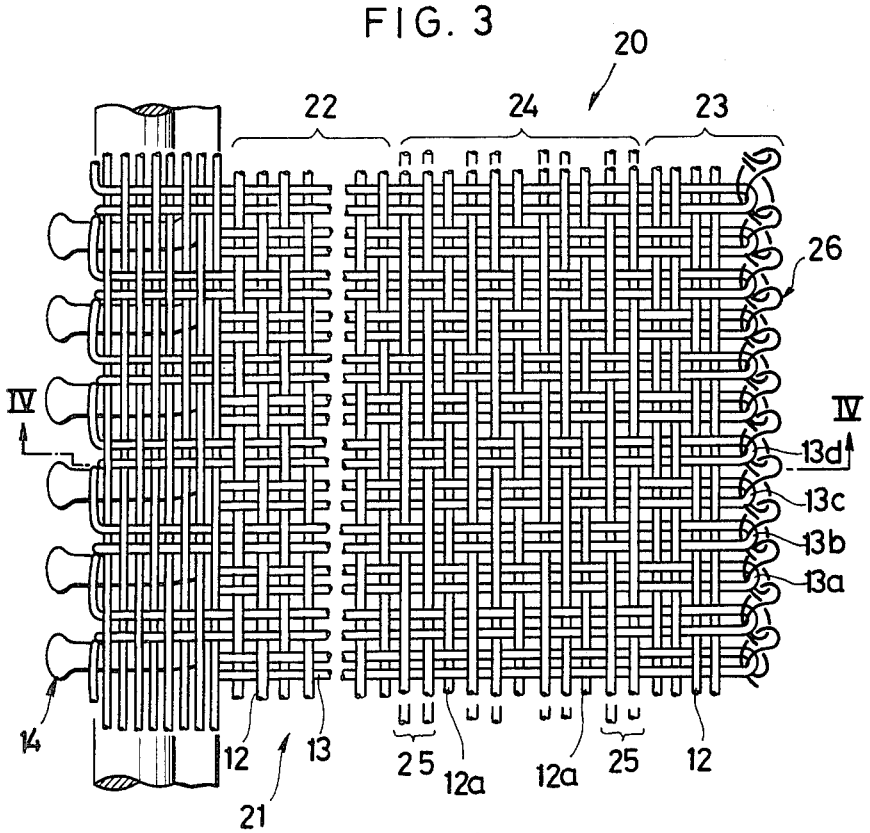
FIG. 3 is a fragmentary schematic plan view of a modified woven slide fastener stringer.
Figure 4:
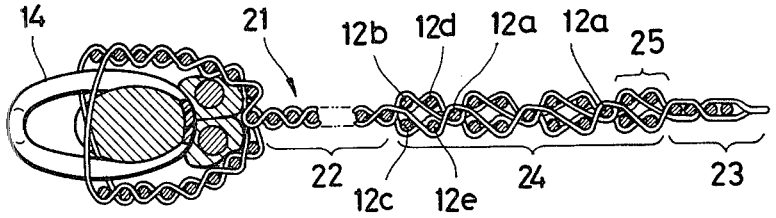
FIG. 4 is a cross-sectional view taken along line IV—IV of FIG. 3.
Figure 5:
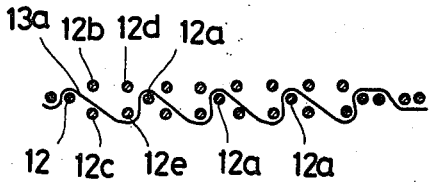
FIGS. 5 to 8 are schematic transverse cross-sectional views of a portion of a stringer tape shown in FIGS. 3 and 4, illustrating the manner in which individual weft yarns are interlaced with warp yarns.
Figure 6:
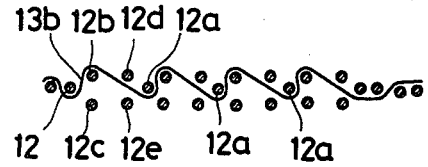
Figure 7:
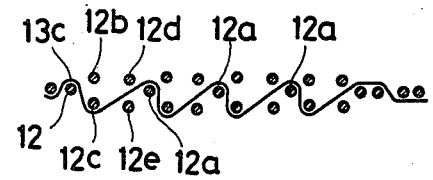
Figure 8:
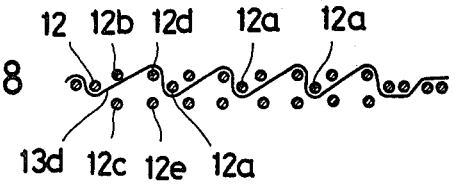

FIGS. 3 and 4 show a modified woven slide fastener stringer 20 having a modified stringer tape 21. The modified stringer tape 21 includes a first marginal portion 22 adjacent to the coupling-element-supporting tape edge, a second marginal portion 23 adjacent to the other longitudinal tape edge, i.e., a selvedge 26, and an intermediate portion 24 extending between the first and second marginal portions 22,23. The weft yarns 13 extend over one of the warp yarns 12 and under the next alternately across the first marginal portion 22. At the second marginal portion 23 two pairs of the warp yarns 12 are interlaced with the weft yarns 13 in "plain weave" so that the weft yarns 13 can be prevented from being excessively tightened.

As best shown in FIG. 4, the intermediate tape portion 24 includes a plurality of groups 25 of the warp yarns 12, there being a single warp yarn 12*a* interposed between adjacent groups 25. Each group 25 includes two pairs of warp yarns 12*b*,12*c* and 12*d*,12*e* (FIG. 4). The warp yarns 12*b*,12*d* are vertically aligned with the warp yarns 12*c*,12*e*, respectively.

FIGS. 5 to 8 illustrate the manner in which the individual weft yarns 13*a*,13*b*,13*c*,13*d* are interlaced with the wrap yarns 12*a*,12*b*,12*c*,12*d*,12*e*. The first weft yarns 13*a* (FIG. 5) extend (from left to right) through a space between the warp yarns 12*b*, 12*d*, then under the warp yarns 12*d*,12*e*, and over the single warp yarn 12*a* and repeat the same until they traverse, and then they are returned across the warps threads in the same weaving pattern to thereby insert double picks. The second weft yarns 13*b* (FIG. 6) extend over the warp yarns 12*b*,12*c*, then through a space between the warp yarns 12*d*,12*e*, and under the single warp yarn 12*a* and repeat the same until they traverse, and then they are returned across the warp threads in the same weaving pattern to thereby insert double picks. The third weft yarns 13*c* (FIG. 7) extend under the warp yarns 12*b*,12*c*, then through a space between the warp yarns 12*d*,12*e*, and over the single warp yarn 12*a* and repeat the same until they traverse, and then they are returned across the warp threads in the same weaving pattern to thereby insert double picks. The fourth weft yarns 13*d* (FIG. 8) extend through a space between the warp yarns 12*b*,12*c*, then over the warp yarns 12*d*,12*e*, and under the single warp yarn 12*a* and repeat the same until they traverse, and then they are returned across the warp threads in the same weaving pattern to thereby insert double picks.

Like the preceding embodiment shown in FIGS. 1 and 2, the stringer tape 21 has a sufficiently coarse and thick woven structure, enabling the slide fastener stringer 20 to be sewn to a garment easily and properly.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A woven slide fasterner stringer compising:

a. a stringer tape woven of warp and weft yarns; and b. a row of fastener coupling elements woven into said stringer tape along one longitudinal edge thereof;

c. said stringer tape including:

1. a first marginal portion disposed adjacent to said longitudinal edge, said weft yarns extending over one of said warp yarns and under a succeeding one of said warp yarns alternately across said first marginal portion;

2. a second marginal portion disposed adjacent to the other longitudinal edge; and 3. an intermediate portion extending between said first and second marginal portions, and having a woven structure coarser and thicker than that of said first marginal portion, the number of interlacings of said warp and weft yarns per unit area thereof being smaller than that in said first marginal portion, said weft yarns thereof extending over a group of said warp yarns and under a succeeding group of said warp yarns alternately across said intermediate portion, the warp yarns in each of said group being disposed in a row, the number of said warp yarns in said groups increasing gradually from the group adjacent to said first marginal portion to the group adjacent to said second marginal portion.

2. A woven slide fastener stringer comprising:

a. a stringer tape woven of warp and weft yarns; and b. a row of fastener coupling elements woven into said stringer tape along one longitudinal edge thereof;

c. said stringer tape including:

1. a first marginal portion disposed adjacent to said longitudinal edge;

2. a second marginal portion disposed adjacent to the other longitudinal edge; and 3. an intermediate portion extending between said first and second marginal portions, and having a woven structure coarser and thicker than that of said first marginal portion, the number of interlacings of said warp and weft yarns per unit area thereof being smaller than that in said first marginal portion, the warp yarns thereof being arranged in a plurality of groups, the warp yarns in each group lying over and under one another.

* * * * *